US007788852B2

(12) United States Patent
Wexler et al.

(10) Patent No.: US 7,788,852 B2
(45) Date of Patent: Sep. 7, 2010

(54) SEALING DEVICE

(76) Inventors: Elias Wexler, 6 Rural Dr., Scarsdale, NY (US) 10583; Jacob Wexler, 6 Rural Dr., Scarsdale, NY (US) 10583

( * ) Notice: Subject to any disclaimer, the term of this patent is extended or adjusted under 35 U.S.C. 154(b) by 0 days.

(21) Appl. No.: 12/036,485

(22) Filed: Feb. 25, 2008

(65) Prior Publication Data

US 2009/0211165 A1 Aug. 27, 2009

(51) Int. Cl.
*E06B 7/16* (2006.01)

(52) U.S. Cl. ..... 49/482.1; 49/493.1; 49/498.1

(58) Field of Classification Search ..... 49/498.1, 49/482.1, 493.1, 475.1
See application file for complete search history.

(56) References Cited

U.S. PATENT DOCUMENTS

| | | | | |
|---|---|---|---|---|
| 399,413 | A * | 3/1889 | Jones | 49/482.1 |
| 1,783,305 | A * | 12/1930 | Olson | 49/482.1 |
| 1,986,465 | A * | 1/1935 | Dempsey | 277/632 |
| 3,562,957 | A * | 2/1971 | Landis | 49/493.1 |
| 4,490,943 | A * | 1/1985 | McLaughlin | 49/478.1 |
| 4,765,676 | A * | 8/1988 | Grimm et al. | 296/216.09 |
| 4,813,184 | A * | 3/1989 | Weimar | 49/477.1 |
| 5,466,508 | A * | 11/1995 | Brocke et al. | 428/122 |
| 5,581,951 | A * | 12/1996 | Ryan et al. | 49/498.1 |
| 6,401,398 | B1 * | 6/2002 | Panayides et al. | 49/498.1 |
| 6,598,349 | B1 * | 7/2003 | Balbaugh et al. | 49/490.1 |
| 6,739,094 | B1 * | 5/2004 | Berry et al. | 49/478.1 |
| 6,811,213 | B2 * | 11/2004 | Yamashita et al. | 296/216.06 |
| 2003/0188491 | A1 * | 10/2003 | Aritake | 49/490.1 |
| 2006/0005472 | A1 * | 1/2006 | Miller | 49/498.1 |

* cited by examiner

*Primary Examiner*—Katherine W Mitchell
*Assistant Examiner*—Michael J Keller
(74) *Attorney, Agent, or Firm*—Fitzpatrick, Cella, Harper & Scinto

(57) ABSTRACT

A door seal includes an elongated mounting strip adapted to be secured to a door frame and a flexible sealing strip adapted to be positioned between the mounting strip and the door frame for sealing the space between the door and the frame thereby to reduce transmission of noise and air through that space. The flexible sealing strip is formed from a series of individual separate strip segments aligned next to each other along the mounting strip.

11 Claims, 2 Drawing Sheets

SEALING DEVICE

FIELD OF THE INVENTION

The present invention relates to an improved sealing device for forming a seal between a frame and a movable panel in the frame such as a door.

BACKGROUND OF THE INVENTION

Doors seals have previously been provided in any variety of different forms for the purpose of forming an air seal along the openings between the door and the door frame or floor. Typically such seals consist of a rigid mounting strip having a flexible sealing member secured thereto. The mounting strip is secured to the door frame in any convenient manner with the seal member positioned between the mounting strip and the frame and extending into the open space between the frame and the edge of the adjacent door, window or panel. Preferably these seals are formed of a flexible material which will occupy or block the space and prevent noise and/or air from passing through the opening.

In the past, the sealing strips of the prior art have been provided as elongated sealing strips having the same length as the mounting strip.

While the prior art sealing strips have been very satisfactory in operation, they have been unsuitable for use in institutional establishments, such as prisons or mental hospitals, because the mounting strip is readily removed from the door frame thereby providing access to the seal. Since the seal is a relatively strong flexible elongated member, the seal is then capable of being used for unintended purposes as a rope or weapon. Accordingly, such institutions have not been able to make use of conventional sealing strips for their desired advantageous purposes.

SUMMARY OF THE INVENTION

It is an object of the present invention to provide an improved sealing member for a door or the like which cannot be used as a weapon or rope.

Another object of the present invention is to provide a safe door seal arrangement having the same noise and air abatement characteristics of single strip elements used in the prior art.

A still further object of the present invention is to provide a door seal having the desired characteristics described herein which is relatively simple in construction and simple and inexpensive to manufacture.

In accordance with an aspect of the present invention the sealing device consists of a mounting element similar to that used in the prior art which is formed of a rigid material such as hard plastic, aluminum, bronze, steel or stainless steel. The mounting strip is adapted to be secured to a frame of a door or window in any convenient manner such as for example by a plurality of screws. The mounting strip supports a sealing strip positioned between the mounting strip and the door frame, with a portion of the sealing strip extending across the frame to contact the adjacent door or panel thereby blocking off the space normally provided between the panel and the frame. The seal member is formed of a flexible material such as neoprene, rubber, vinyl, silicon, santoprene or EPDM, preferably with a cylindrical bead at its free end occupying the space adjacent the frame and panel.

In accordance with another aspect of the invention the sealing strip is formed of a plurality of individual strip segments, of for example 6" inches in length or less. The segments can simply be clamped against the frame by the mounting member or adhered to the mounting member by a conventional adhesive or the like as desired. The sealing strip of this invention has the advantage that if the mounting strip is removed from the jamb, the strip itself is segmented and cannot be used as a weapon or a rope.

The above and other objects, features and advantages of the present invention will be apparent to those skilled in the art from the following detailed description of an illustrative embodiment thereof, which is to be read in connection with the accompanying drawings wherein:

DETAILED DESCRIPTION OF THE DRAWINGS

Figure 1:
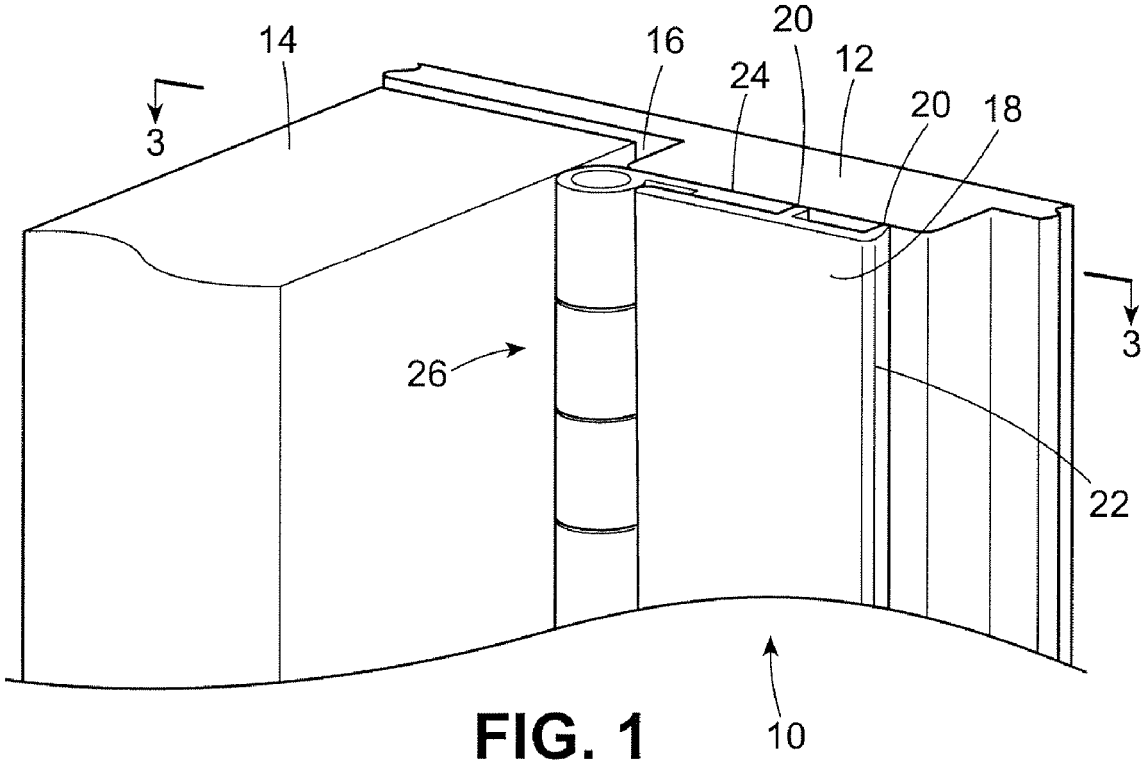
FIG. 1 is a partial prospective view of a door frame and door having a sealing device constructed in accordance with present invention mounted on the door frame.
Figure 2:
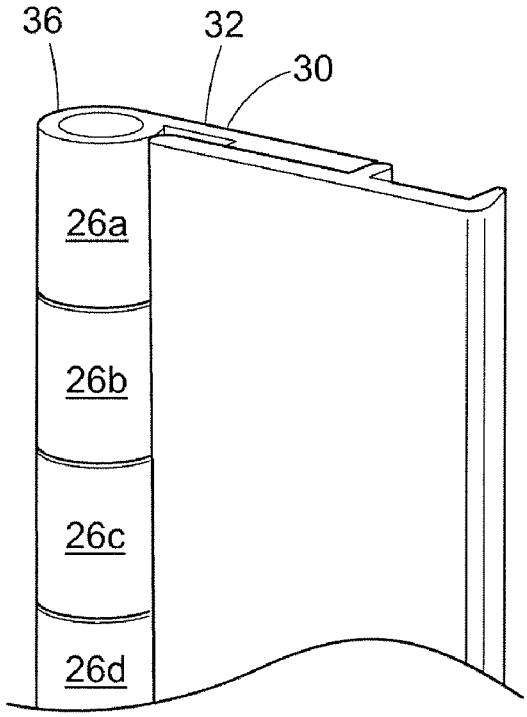
FIG. 2 is a slightly enlarged partial prospective view of the sealing device of the present invention.

Referring now to the drawings in detail, initially to FIG. 1 thereof a sealing device 10, constructed in accordance with the present invention, is shown mounted on a frame element 12 of a conventional door frame. A door 14 is pivotally mounted on the door frame element 12 (or on an opposing door frame, facing frame 12) in any convenient and known manner.

Although the invention is described herein with reference to a door and door frame, it is to be understood that the sealing device 10 of the present invention can be used with windows and window frames, or along the base of a door and the adjacent door saddle. The purpose of the sealing device is to form a seal at the opening 16 between the frame or jamb and the door or panel to prevent or limit the transmission of noise or air flow from one side of the door to the other through the opening 16.

Sealing device 10 includes an elongated mounting strip 18 which can be formed of a rigid plastic or a metal such as aluminum. The mounting strip is relatively flat, but in the illustrative embodiment it has a pair of short legs 20 spaced from each other along its outer edge 22. These legs hold the mounting strip 18 slightly away from the doorjamb in order to provide a space 24 in which the sealing element 26 of the present invention is mounted.

Figure 3:
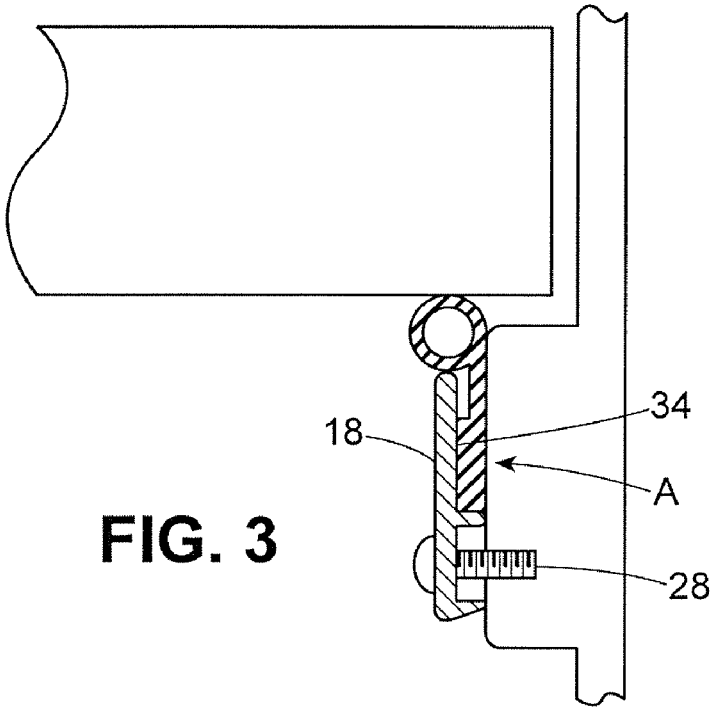
FIG. 3 is a sectional view taken along line 3-3 of FIG. 1.
Figure 4:
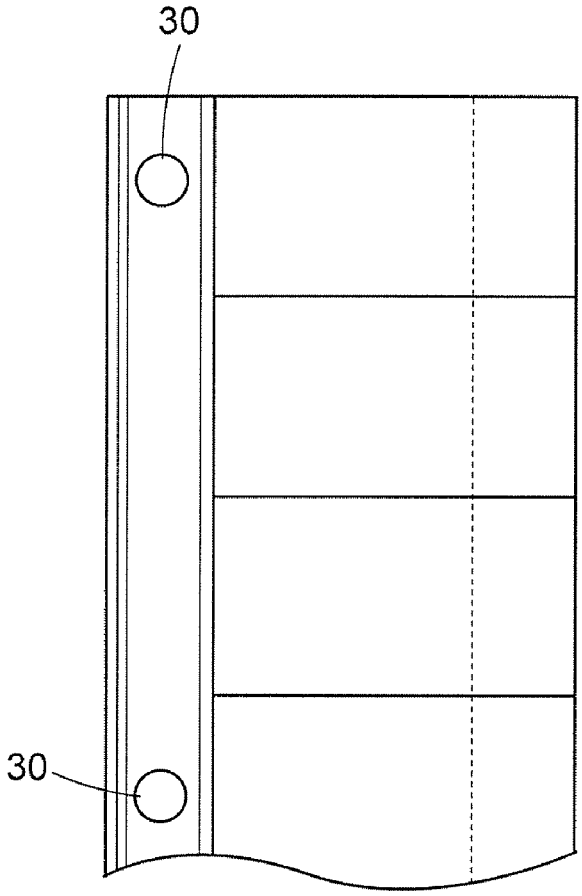
FIG. 4 is a rear view of the sealing device of the present invention taken in the direction of the arrow A in FIG. 3.

The mounting strip 18 is secured to the door jamb in any convenient manner, such as for example by a plurality of screws 28 (see FIG. 3) which extend through screw openings 30 formed in the strip 18 between the legs 20, as seen in FIG. 4, into the frame.

The sealing strip 26 is preferably formed of a flexible material such as rubber or neoprene. In the illustrated embodiment, the seal has a relatively flat leg 30 which is positioned within the space 24. The leg 30 has a narrow section 32 to allow some flexing of the strip in the space 24 during engagement with the door. The leg 30 can be simply clamped into place by the action of the mounting strip 18 under the influence of the screws 28 or, preferably, can be adhered to the mounting strip 18 by an adhesive on the surface 34 thereof which engages the mounting strip, as seen in FIG. 3. The adhesive used is a matter of choice to those skilled in the art and knowledgeable about such seals.

The seal 26 of the preferred embodiment includes a cylindrical sealing bead or means 36 which can be solid or hollow, as illustrated.

As mentioned above, in the prior art, seal 26 is an elongated one piece member. However, in accordance with the present invention, the seal 26 is formed from a plurality of segments 26*a-d*, etc., each of which has a length that is about 3 inches or less. As a result, should the mounting strip be removed from the door jamb, intentionally or unintentionally, the strip will separate into its various segments, and will not be available for use as a weapon or rope. Accordingly, the sealing device of the present invention is suitable for use in institutions where such devices could not be used in the past.

Although the invention has been shown and described herein with reference to a preferred embodiment, various changes and modifications can be affected therein by those skilled in the art without departing from a scope or spirit of the present invention. For example, instead of a cylindrical sealing bead or means, the seal 36 could be a solid flat strip or other shapes known in the art. All such changes and modifications will fall within the scope or spirit of the invention.

What is claimed is:

1. A door seal for use in security institutions such as prisons and mental hospitals comprising an elongated relatively rigid mounting strip adapted to be secured to a door frame and a flexible sealing strip, said sealing strip comprising at least one straight linear section that includes a plurality of separate individual linear strip segments, each of which includes a leg portion positioned between said mounting strip and a door frame and each strip segment having sealing means for sealing the space between the door frame and the door to reduce transmission of noise and air there through; and means for releasably securing said leg portions of the sealing strip segments in abutting adjacent alignment with one another on said mounting strip such that each of said strip segments is independently removable, said strip segments not being interlocked with one another.

2. A door seal as defined in claim 1 where said means for securing said leg portions of said strip segments to said mounting strip is an adhesive.

3. A door seal as defined in claim 2 where said strip segments are formed of a flexible material.

4. A door seal as defined in claim 3 where said strip segments are formed of rubber.

5. A door seal as defined in claim 1 where said sealing means comprises a cylindrical bead formed on each of said strip segments.

6. A seal for use in security institutions such as prisons and mental hospitals for sealing the space between a mounting frame and a movable panel mounted within said frame to prevent noise and/or air from passing there through, said seal comprising a relatively rigid elongated mounting strip adapted to be secured to a frame and an elongated flexible sealing strip, a portion of which is positioned between the mounting strip and the frame and including sealing means for sealing the space between the frame and a panel adjacent thereto to reduce transmission of noise and air there through; said flexible strip comprising at least one straight linear section that includes a plurality of individual linear strip segments each of which includes a leg portion engaged with said mounting strip for mounting on the frame, and a section of the sealing means for sealing the space between the frame and the movable panel; and means for releasably securing said leg portions in abutting aligned relationship to one another on the mounting strip such that each of said strip segments is independently removable, said strip segments not being interlocked with one another.

7. A seal as defined in claim 6 wherein said seal segments each have a length of about 6 inches or less.

8. A seal as defined in claim 7 where said strip segments are formed of neoprene.

9. A seal as defined in claim 8 where said sealing means comprises a cylindrical bead formed on each of said strip segments.

10. A seal as defined in claim 6 where said mounting strip includes a pair of spacing legs for engaging an adjacent frame to space the mounting strip from the frame to provide a space for said strip segment leg portions.

11. A seal as defined in claim 10 wherein said strip segment leg portions each have a reduced thickness section adjacent said means for sealing to allow flexing of the strip.

* * * * *